US011959033B2

(12) United States Patent
Price et al.

(10) Patent No.: US 11,959,033 B2
(45) Date of Patent: Apr. 16, 2024

(54) FUEL COMPOSITION

(71) Applicant: SHELL OIL COMPANY, Houston, TX (US)

(72) Inventors: Richard John Price, Chester (GB); Caroline Nicola Orlebar, London (GB); Marcello Stefano Rigutto, Amsterdam (NL); Richard Hugh Clark, Manchester (GB); Jasprit Kaur Chahal, London (GB)

(73) Assignee: SHELL USA, INC., Houston, TX (US)

( * ) Notice: Subject to any disclaimer, the term of this patent is extended or adjusted under 35 U.S.C. 154(b) by 398 days.

(21) Appl. No.: 15/778,789

(22) PCT Filed: Nov. 28, 2016

(86) PCT No.: PCT/EP2016/079044
§ 371 (c)(1),
(2) Date: May 24, 2018

(87) PCT Pub. No.: WO2017/093203
PCT Pub. Date: Jun. 8, 2017

(65) Prior Publication Data

US 2018/0355265 A1 Dec. 13, 2018

(30) Foreign Application Priority Data

Nov. 30, 2015 (EP) ..... 15197085

(51) Int. Cl.
*C10L 1/02* (2006.01)

(52) U.S. Cl.
CPC ..... *C10L 1/02* (2013.01); *C10L 1/023* (2013.01); *C10G 2400/02* (2013.01); *C10L 2270/023* (2013.01)

(58) Field of Classification Search
CPC .. C10L 1/06; C10L 1/16; C10L 1/1608; C10L 1/1616; C10L 1/1641;
(Continued)

(56) References Cited

U.S. PATENT DOCUMENTS 4,125,566 A 11/1978 Trin Dinh et al.
4,385,193 A 5/1983 Bijwaard et al.
(Continued)

FOREIGN PATENT DOCUMENTS

EP 0310875 A1 4/1989
EP 0583836 A1 2/1994
(Continued)

OTHER PUBLICATIONS

International Search Report and Written Opinion received for PCT Patent Application No. PCT/EP2016/079044, dated Feb. 6, 2017, 11 pages.
(Continued)

*Primary Examiner* — Latosha Hines
(74) *Attorney, Agent, or Firm* — SHELL USA, INC.

(57) ABSTRACT

A liquid fuel composition for a spark ignition internal combustion engine comprising (a) gasoline blending components, (b) Fischer-Tropsch derived naphtha at a level of up to 50% v/v and (c) oxygenated hydrocarbon at a level less than 50% v/v. While the low octane number of Fischer-Tropsch derived naphtha would normally severely restrict its blendability in gasoline to low levels, it has now been found that Fischer-Tropsch derived naphtha can be included in, for example, ethanol-containing gasoline fuel compositions, in surprisingly and significantly high blend ratios of Fischer-Tropsch derived naphtha to ethanol.

14 Claims, 2 Drawing Sheets

(58) Field of Classification Search
CPC ..... C10L 1/1817; C10L 1/02; C10L 1/023; C10L 2270/023; C10G 2400/02
See application file for complete search history.

(56) References Cited

U.S. PATENT DOCUMENTS

| | | | | |
|---|---|---|---|---|
| 4,478,955 | A | 10/1984 | Pesa et al. | |
| 4,594,468 | A | 6/1986 | Minderhound et al. | |
| 4,849,572 | A | 7/1989 | Chen et al. | |
| 4,877,416 | A | 10/1989 | Campbell | |
| 4,943,672 | A | 7/1990 | Hamner et al. | |
| 5,004,478 | A | 4/1991 | Vogel et al. | |
| 5,059,299 | A | 10/1991 | Cody et al. | |
| 5,112,364 | A | 5/1992 | Rath et al. | |
| 5,298,039 | A | 3/1994 | Mohr et al. | |
| 5,660,601 | A | 8/1997 | Oppenlaeander et al. | |
| 5,746,786 | A | 5/1998 | Mueller et al. | |
| 5,855,629 | A | 1/1999 | Grundy et al. | |
| 6,069,281 | A | 5/2000 | Kropp et al. | |
| 6,162,956 | A | 12/2000 | Berlowitz et al. | |
| 6,204,426 | B1 | 3/2001 | Miller et al. | |
| 6,267,791 | B1 | 7/2001 | Thomas et al. | |
| 6,541,524 | B2 * | 4/2003 | O'Rear | C10G 2/32 208/133 |
| 6,544,407 | B1 | 4/2003 | Calemma et al. | |
| 6,607,568 | B2 | 8/2003 | Wittenbrink et al. | |
| 6,663,767 | B1 | 12/2003 | Berlowitz et al. | |
| 6,755,961 | B1 | 6/2004 | Berlowitz et al. | |
| 6,787,022 | B1 | 9/2004 | Berlowitz et al. | |
| 6,822,131 | B1 | 11/2004 | Berlowitz et al. | |
| 6,833,064 | B2 | 12/2004 | Berlowitz et al. | |
| 6,860,909 | B2 | 3/2005 | Berlowitz et al. | |
| 7,252,754 | B2 | 8/2007 | DeHaan et al. | |
| 7,901,470 | B2 | 3/2011 | Graupner et al. | |
| 8,372,164 | B2 | 2/2013 | Haan et al. | |
| 8,486,876 | B2 | 7/2013 | Brewer et al. | |
| 8,518,130 | B2 | 8/2013 | Croft et al. | |
| 8,557,001 | B2 | 10/2013 | Brewer et al. | |
| 8,709,111 | B2 | 4/2014 | Felix-Moore et al. | |
| 8,741,002 | B2 | 6/2014 | Felix-Moore et al. | |
| 8,974,552 | B2 * | 3/2015 | Clark | C10L 1/023 44/451 |
| 9,133,080 | B2 | 9/2015 | Abhari et al. | |
| 9,206,366 | B2 | 12/2015 | Bauldreay et al. | |
| 2006/0054865 | A1 | 3/2006 | Smith et al. | |
| 2009/0165363 | A1 * | 7/2009 | Clayton | C10L 1/1641 44/300 |
| 2010/0000484 | A1 | 1/2010 | Felix-Moore et al. | |
| 2010/0326387 | A1 * | 12/2010 | Yeh | F02B 1/12 123/1 A |
| 2013/0227878 | A1 | 9/2013 | Wolf et al. | |
| 2014/0046103 | A1 | 2/2014 | Abhari et al. | |
| 2015/0166920 | A1 | 6/2015 | Brewer | |

FOREIGN PATENT DOCUMENTS

| | | | |
|---|---|---|---|
| EP | 0668342 | A1 | 8/1995 |
| EP | 0776959 | A2 | 6/1997 |
| WO | 9920720 | A1 | 4/1999 |
| WO | 9934917 | A1 | 7/1999 |
| WO | 0020535 | A1 | 4/2000 |
| WO | 2006031319 | A2 | 3/2006 |

OTHER PUBLICATIONS

Van Der Burgt et al., "The Shell Middle Distillate Synthesis Process", paper delivered at 5th Synfuels Worldwide Symposium, Nov. 1985, pp. 1-15.

Van Der Burgt et al., "The Shell Middle Distillate Synthesis Process", Shell International Petroleum Company Ltd., Nov. 1989. pp. 1-8.

Sagarin et al., Cosmetics Science and Technology, 1972, 20 pages.

Rankovic et al., "Understanding Octane Number Evolution for Enabling Alternative Low Ron Refinery Streams and Octane Boosters as Transportation Fuels", Fuel, vol. 150, 2015, pp. 41-47.

"Fiche de Donnees de Securite", Supercarburant Sans Plomb 95/E10, Nov. 26, 2014.

Analyse de deux bio-naphtas realisee par l'opposante, 1 page.

Wauquier, Raffinage Du Petrole (Le). Tome 1. Petrole Brut. Produits Petroliers. Schemas De Fabrication, 1998, p. 203.

* cited by examiner

FUEL COMPOSITION

PRIORITY CLAIM

The present application is the National Stage (§ 371) of International Application No. PCT/EP2016/079044, filed Nov. 28, 2016, which claims priority from European Application No. 15197085.2, filed Nov. 30, 2015 incorporated herein by reference.

FIELD OF THE INVENTION

The present invention is in the field of fuel formulations, particularly gasoline-type fuel formulations.

BACKGROUND OF THE INVENTION

The Fischer-Tropsch conversion of natural gas into paraffinic hydrocarbons via syngas has been commercially established by Shell in Bintulu, Malaysia and at the Pearl plant in Qatar. The hydrocarbons from a Gas-to-Liquid (GTL) process typically follow an Anderson-Schulz-Flory distribution:

$$W_n/n=(1-\alpha)^2\alpha^{n-1}$$

where $W_n$ is the weight fraction of a hydrocarbon containing n carbon atoms. The probability that a molecule will continue to form a longer chain ($\alpha$) is dependent upon both catalyst and process conditions. Irrespective of the adjustment of catalyst and/or conditions, a light fraction of $C_4$ to $C_{11}$ hydrocarbons (GTL naphtha) is always produced.

Whereas the longer chain molecules in GTL gasoil have a high cetane number and can be blended into diesel, GTL naphtha has historically not been used in gasoline because of its poor octane rating (RON and MON of 27-32). This has been the case despite the fact that GTL naphtha has comparable distillation properties to those of gasoline. Instead, the naphtha is used as a steam cracker feedstock for the production of chemicals.

Due to an increase in production volumes of GTL naphtha in recent years, however, it would be advantageous to be able to blend GTL naphtha in gasoline, particularly in high blend ratios.

It is known that Fischer-Tropsch derived naphtha components can only be accommodated at low levels (<5% v/v) in gasoline fuels without ethanol.

WO2009/083466 discloses a liquid fuel composition suitable for use in an internal combustion engine comprising: (a) from 50 to 90% v/v of a $C_1$-$C_4$ alcohol; (b) from 10 to 50% v/v of a Fischer-Tropsch derived naphtha; and optionally (c) up to 10% v/v of a $C_3$-$C_6$ hydrocarbon component.

US2009/300971 discloses a naphtha composition produced from a renewable feedstock wherein the naphtha has a boiling range of about 70° F. to about 400° F. and a specific gravity at 20° C. of from about 0.680 to about 0.740. In one embodiment, the biorenewable naphtha is used as an alternative gasoline fuel for combustion engines when blended between 1% and 85% by volume with ethanol.

RD55021 discloses the use of Biomass-To-Liquid (BTL) Naphtha in combination with oxygenated bio-components (ethanol and/or ethyl tert-butyl ETBE) to achieve specification compliant (EN228) gasoline. FIG. 1 of RD55021 discloses mixtures of BTL naphtha and ethanol/ETBE wherein the usable ratios of ethanol:BTL naphtha contain about 65-100% ethanol and wherein the usable ratios of ETBE: BTL naphtha contain about 70-100% ETBE.

RD604041 relates to the use of butanol and GTL naphtha in transport fuels, and discloses 3-component blends including ethanol, butanol and GTL naphtha. FIG. 1 shows the impact on RON and RVP of variation in ethanol content in a blend including 10% volume of GTL naphtha (balance of blend is n-butanol). In FIG. 1 the ethanol content varies between 20% vol. to 80% vol. and the n-butanol content varies between 70% vol. and 10% vol. FIG. 2 shows the impact on RON and RVP of variation in ethanol content in a blend including 10% volume GTL naphtha (balance of blend is i-butanol). In FIG. 2, the ethanol content varies between 20% vol. to 80% vol. and the i-butanol content varies between 70% vol. and 10% vol.

While the low octane number of Fischer-Tropsch derived naphtha would normally severely restrict its blendability in gasoline to low levels, it has now been found by the present inventors that Fischer-Tropsch derived naphtha can be included in, for example, ethanol-containing gasoline fuel compositions in surprisingly and significantly high blend ratios of Fischer-Tropsch derived naphtha to ethanol.

SUMMARY OF THE INVENTION

According to a first aspect of the present invention there is provided a liquid fuel composition for a spark ignition internal combustion engine comprising (a) gasoline blending components, (b) Fischer-Tropsch derived naphtha at a level of up to 50 vol. % and (c) oxygenated hydrocarbon at a level less than 50 vol. %.

This invention enables the use of Fischer-Tropsch derived naphtha at significantly high blend ratios in unleaded gasoline 95 (ULG95) and unleaded gasoline 98 (ULG98) and thereby provides a significant new outlet for Fischer-Tropsch derived naphtha in fuel.

The liquid fuel compositions of the present invention also provide excellent fuel economy, emissions and power benefits, as required by the EN228 specification.

This invention enables the use of Fischer-Tropsch derived naphtha at significantly high blend ratios particularly in unleaded gasoline of lower RON, for example 95 (ULG95). Therefore, according to another aspect of the present invention there is provided a liquid fuel composition for a spark ignition internal combustion engine comprising (a) gasoline blending components, (b) Fischer-Tropsch derived naphtha at a level of at least 10% v/v and (c) oxygenated hydrocarbon at a level less than 50% v/v, wherein the liquid fuel composition has a Research Octane Number (RON) of 96 or less.

DETAILED DESCRIPTION OF THE INVENTION

Figure 1:
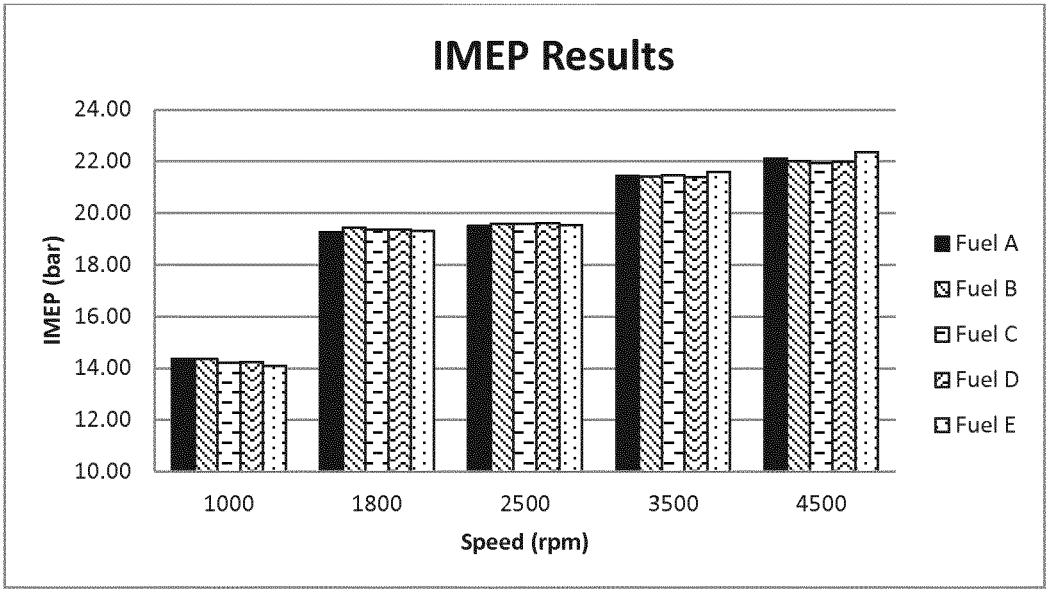
FIG. 1 is a graphical representation of the results shown in Table 13.

The liquid fuel composition of the present invention comprises gasoline blending components, such as a gasoline base fuel, suitable for use in an internal combustion engine, a Fischer-Tropsch derived naphtha at a level of up to 50% v/v and (c) oxygenated hydrocarbon at a level less than 50% v/v. Therefore the liquid fuel composition of the present invention is a gasoline composition.

The term "comprises" as used herein is intended to indicate that as a minimum the recited components are included but that other components that are not specified may also be included as well.

The liquid fuel compositions herein comprise a naphtha. The person skilled in the art would know what is meant by the term "naphtha". Typically, the term "naphtha" means a mixture of hydrocarbons generally having between 5 and 12 carbon atoms and having a boiling point in the range of 30 to 200° C. The liquid fuel compositions herein comprise a naphtha which is preferably a Fischer-Tropsch derived naphtha.

By "Fischer-Tropsch derived" is meant that the naphtha is, or is derived from, a product of a Fischer-Tropsch synthesis process (or Fischer-Tropsch condensation process). A Fischer-Tropsch derived naphtha may also be referred to as a GTL (Gas-to-Liquid) naphtha.

The Fischer-Tropsch reaction converts carbon monoxide and hydrogen (synthesis gas) into longer chain, usually paraffinic, hydrocarbons:

$$n(CO+2H_2)=(—CH_2—)n+nH_2O+\text{heat},$$

in the presence of an appropriate catalyst and typically at elevated temperatures (e.g., 125 to 300° C., preferably 175 to 250° C.) and/or pressures (e.g., 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. The gases which are converted into synthesis gas, which are then converted into liquid fuel components using Fischer-Tropsch synthesis can in general include natural gas (methane), Liquid petroleum gas (LPG) (e.g., propane or butane), "condensates" such as ethane, and gaseous products derived from coal, biomass and other hydrocarbons.

The Fischer-Tropsch derived naphtha may be obtained directly from the Fischer-Tropsch reaction, or derived indirectly from the Fischer-Tropsch reaction, for instance by fractionation of Fischer-Tropsch synthesis products and/or by hydrotreatment of Fischer-Tropsch synthesis products. Hydrotreatment can involve hydrocracking to adjust the boiling range (see, e.g., GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566, 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described by van der Burgt et al. in "The Shell Middle Distillate Synthesis Process", paper delivered at the 5th Synfuels Worldwide Symposium, Washington DC, November 1985 (see also the November 1989 publication of the same title from Shell International Petroleum Company Ltd, London, UK). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce the desired product, for example Fischer-Tropsch derived naphtha or liquid transport fuels such as the gas oils useable in diesel fuel compositions. A version of the SMDS process, utilising a fixed bed reactor for the catalytic conversion step, is currently in use in Bintulu, Malaysia and its gas oil products have been blended with petroleum derived gas oils in commercially available automotive fuels.

Examples of other Fischer-Tropsch synthesis processes include the so-called commercial Slurry Phase Distillate technology of Sasol and the "AGC-21" ExxonMobil process. These and other processes are, for example, described in more detail in EP-A-776 959, EP-A-668 342, U.S. Pat. Nos. 4,943,672, 5,059,299, WO-A-99/34917 and WO-A-99/20720.

Fischer-Tropsch derived naphtha prepared by the SMDS process is commercially available for instance from Shell companies. Further examples of Fischer-Tropsch derived products are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived naphtha has essentially no, or undetectable levels of, sulphur and nitrogen. Compounds containing these heteroatoms tend to act as poisons for Fischer-Tropsch catalysts and are therefore removed from the synthesis gas feed.

Further, the Fischer-Tropsch process as usually operated produces no or virtually no aromatic components. The aromatics content of a Fischer-Tropsch derived naphtha, suitably determined by ASTM D4629, will typically be below 1% w/w, preferably below 0.5% w/w and more preferably below 0.2 or 0.1% w/w.

Generally speaking, Fischer-Tropsch derived naphthas have relatively low levels of polar components, in particular polar surfactants, for instance compared to petroleum derived naphthas. Such polar components may include for example oxygenates, and sulphur- and nitrogen-containing compounds. A low level of sulphur in a Fischer-Tropsch derived naphtha is generally indicative of low levels of both oxygenates and nitrogen containing compounds, since all are removed by the same treatment processes.

The Fischer-Tropsch derived naphtha component of the present invention is a liquid hydrocarbon distillate with a final boiling point of typically up to 220° C., preferably up to 180° C. or 175° C. Its initial boiling point is typically at least 25° C., preferably at least 30° C.

The Fischer-Tropsch derived naphtha, or the majority of the Fischer-Tropsch derived naphtha (for example, at least 95% w/w), is typically comprised of hydrocarbons having 5 or more carbon atoms.

Suitably, the Fischer-Tropsch derived naphtha component of the present invention will consist of at least 70% w/w, preferably at least 80% w/w, more preferably at least 90 or 95 or 98% w/w, most preferably at least 99 or 99.5 or even 99.8% w/w, of paraffinic components. By the term "paraffinic", it is meant a branched or non-branched alkane (herein also referred to as iso-paraffins and normal paraffins) or a cycloalkane. Preferably the paraffinic components are iso- and normal paraffins.

The amount of normal paraffins in the Fischer-Tropsch derived naphtha is up to 100% w/w. Preferably, the Fischer-Tropsch derived naphtha contains from 20 to 98% w/w or greater of normal paraffins.

The weight ratio of iso-paraffins to normal paraffins may suitably be greater than 0.1 and may be up to 12; suitably it is from 2 to 6. The actual value for this ratio may be determined, in part, by the hydroconversion process used to prepare the gas oil from the Fischer-Tropsch synthesis product.

The olefin content of the Fischer-Tropsch derived naphtha component of the present invention is preferably 2.0% w/w or lower, more preferably 1.0% w/w or lower, and even more preferably 0.5% w/w or lower. The aromatic content of the Fischer-Tropsch derived naphtha component of the present invention is preferably 2.0% w/w or lower, more preferably 1.0% w/w or lower, and even more preferably 0.5% w/w or lower.

The Fischer-Tropsch derived naphtha component of the present invention preferably has a density of from 0.67 to 0.73 g/cm3 at 15° C. and a sulphur content of 5 mg/kg or less, preferably 2 mg/kg or less.

It will be appreciated by the skilled person that Fischer-Tropsch derived naphtha will have a very low anti-knock index. Typically, the Research Octane Number (RON), as measured by ASTM D2699, and the Motor Octane Number (MON), as measured by ASTM D2700, of the Fischer-Tropsch derived naphtha component of the present invention will, independently, be at most 60, more typically at most 50, and commonly at most 40.

Preferably, the Fischer-Tropsch derived naphtha component of the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably, it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Suitably, the Fischer-Tropsch derived naphtha component of the present invention is a product prepared by a low temperature Fischer-Tropsch process, by which is meant a process operated at a temperature of 250° C. or lower, such as from 125 to 250° C. or from 175 to 250° C., as opposed to a high temperature Fischer-Tropsch process which might typically be operated at a temperature of from 300 to 350° C.

In the liquid fuel composition herein, the Fischer-Tropsch derived naphtha component of the present invention may include a mixture of two or more Fischer-Tropsch derived naphthas or a mixture of petroleum-derived naphtha and Fischer-Tropsch derived naphtha.

The concentration of Fischer-Tropsch derived naphtha in the liquid fuel composition described herein is up to 50% v/v, preferably from 3% v/v to 25% v/v. Preferably, the concentration of the Fischer-Tropsch derived naphtha in the liquid fuel composition described herein accords with a combination of one of parameters (xi) to (xvii) and one of parameters (xviii) to (xxii) below:—

(xi) at least 5% v/v
(xii) at least 10% v/v
(xiii) at least 11% v/v,
(xiv) at least 12% v/v,
(xv) at least 13% v/v,
(xvi) at least 14% v/v,
(xvii) at least 15% v/v, with features (xi), (xii), (xiii), (xiv), (xv), (xvi) and (xvii) being progressively more preferred; and (xviii) up to 50% v/v,
(xix) up to 40% v/v,
(xx) up to 35% v/v,
(xxi) up to 32% v/v,
(xxii) up to 30% v/v, with features (xviii), (xix), (xx), (xxi) and (xxii) being progressively more preferred.

Examples of specific combinations of the above features are (xi) and (xviii), (xi) and (xix), (xi) and (xx), (xi) and (xxi), (xi) and (xxii), (xii) and (xviii), (xii) and (xix), (xii) and (xx), (xii) and (xxi), (xii) and (xxii), (xiii) and (xviii), (xiii) and (xix), (xiii) and (xx), (xiii) and (xxi), (xiii) and (xxii), (xiv) and (xviii), (xiv) and (xix), (xiv) and (xx), (xiv) and (xxi), (xiv) and (xxii), (xv) and (xviii), (xv) and (xix), (xv) and (xx), (xv) and (xxi), (xv) and (xxii), (xvi) and (xviii), (xvi) and (xix), (xvi) and (xx), (xvi) and (xxi), (xvi) and (xxii), (xvii) and (xviii), (xvii) and (xix), (xvii) and (xx), (xvii) and (xxi), and (xvii) and (xxii).

While in the present invention it is preferred for the naphtha component to be, or to be derived from, a product of a Fischer-Tropsch synthesis process, in an alternative embodiment of the present invention petroleum-derived naphtha may be used in place of, or in addition to, the Fischer-Tropsch derived naphtha.

Hence, according to another aspect of the present invention there is provided a liquid fuel composition for a spark ignition internal combustion engine comprising (a) gasoline blending components, (b) petroleum derived naphtha at a level of up to 50% v/v and (c) oxygenated hydrocarbon at a level less than 50% v/v.

It will be appreciated by a person skilled in the art that the gasoline base fuel may already contain some naphtha components. The concentration of the naphtha referred to above means the concentration of naphtha which is added into the liquid fuel composition as a blend with the gasoline base fuel, and does not include the concentration of any naphtha components already present in the gasoline base fuel.

In addition to the Fischer-Tropsch derived naphtha, the liquid fuel composition of the present invention comprises oxygenated hydrocarbon at a level of less than 50 vol. %, preferably at a level of from 5 to 25% v/v, more preferably at a level of from 5 to 20% v/v.

It will be appreciated by a person skilled in the art that the gasoline base fuel may already contain some oxygenated hydrocarbon components. The concentration of the oxygenated hydrocarbon referred to above means the concentration of oxygenated hydrocarbon which is added into the liquid fuel composition as a blend with the gasoline base fuel, and does not include the concentration of any oxygenated hydrocarbon components already present in the gasoline base fuel.

Examples of suitable oxygenated hydrocarbons that may be incorporated into the gasoline include alcohols, ethers, esters, ketones, aldehydes, carboxylic acids and their derivatives, and oxygen containing heterocyclic compounds, and mixtures thereof. In one embodiment of the present invention the oxygenated hydrocarbon is selected from alcohols, ethers and esters, and mixtures thereof.

Suitable alcohols for use herein include methanol, ethanol, propanol, 2-propanol, butanol, tert-butanol, iso-butanol, 2-butanol and mixtures thereof. Suitable ethers for use herein include ethers containing 5 or more carbon atoms per molecule, e.g., methyl tert-butyl ether and ethyl tert-butyl ether, and mixtures thereof. Suitable esters for use herein include esters containing 5 or more carbon atoms per molecule.

In a preferred embodiment of the present invention the oxygenated hydrocarbon is selected from alcohols, ethers and mixtures thereof. In an especially preferred embodiment of the present invention, the oxygenated hydrocarbon is selected from alcohols. A particularly preferred oxygenated hydrocarbon for use herein is ethanol.

In one preferred embodiment herein the liquid fuel composition comprises from 5 to 10% v/v of oxygenated hydrocarbon and 3 to 15% v/v of Fischer-Tropsch derived naphtha.

In another preferred embodiment herein the liquid fuel composition comprises from 10 to 25% v/v of oxygenated hydrocarbons and 10 to 25% v/v of Fischer-Tropsch derived naphtha.

In the liquid fuel compositions of the present invention, the gasoline blending components may be a gasoline base fuel. The gasoline base fuel may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

The gasoline base fuel may itself comprise a mixture of two or more different gasoline fuel components, and/or be additivated as described below.

Conventionally gasoline base fuels are present in a gasoline or liquid fuel composition in a major amount, for example greater than 50% m/m of the liquid fuel composition, and may be present in an amount of up to 90% m/m, or 95% m/m, or 99% m/m, or 99.9% m/m, or 99.99% m/m, or 99.999% m/m. Suitable the liquid fuel composition contains or consists essentially of the gasoline base fuel in conjunction with up to 50% v/v of Fischer-Tropsch derived naphtha and oxygenated hydrocarbon at a level less than 50% v/v, and optionally one or more conventional gasoline fuel additives, such as specified hereinafter.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline base fuel may be at least 80, for instance in the range of from 80 to 110. Typically, the RON of the gasoline base fuel will be at least 90, for instance in the range of from 90 to 110. Typically, the RON of the gasoline base fuel will be at least 91, for instance in the range of from 91 to 105 (EN 25164). The motor octane number (MON) of the gasoline may conveniently be at least 70, for instance in the range of from 70 to 110. Typically, the MON of the gasoline will be at least 75, for instance in the range of from 75 to 105 (EN 25163).

As mentioned above, Fischer-Tropsch derived naphtha has a very low anti-knock index, and therefore the addition of Fischer-Tropsch derived naphtha to the gasoline base fuel will typically result in a lowering of the RON and MON of the gasoline base fuel.

The liquid fuel composition according to the present invention has a Research Octane Number (RON) in the range of from 85 to 105, for example meeting the European specifications of 95 or premium product grade of 98. The liquid fuel composition used in the present invention has a Motor Octane Number in the range of from 75 to 90.

As demonstrated in the Examples section hereinbelow, the fuel compositions of the present invention exhibit a general trend that the maximum blend ratio of GTL naphtha in EN228 compliant fuel increases as the octane requirement (RON) of the grade is reduced.

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40% v/v based on the gasoline (ASTM D1319); preferably, the olefinic hydrocarbon content of the gasoline is in the range of from 0 to 30% v/v based on the gasoline, more preferably, the olefinic hydrocarbon content of the gasoline is in the range of from 0 to 20% v/v based on the gasoline.

Typically, the aromatic hydrocarbon content of the gasoline is in the range of from 0 to 70% v/v based on the gasoline (ASTM D1319), for instance the aromatic hydrocarbon content of the gasoline is in the range of from 10 to 60% v/v based on the gasoline; preferably, the aromatic hydrocarbon content of the gasoline is in the range of from 0 to 50% v/v based on the gasoline, for instance the aromatic hydrocarbon content of the gasoline is in the range of from 10 to 50% v/v based on the gasoline.

The benzene content of the gasoline is at most 10% v/v, more preferably at most 5% v/v, especially at most 1% v/v based on the gasoline.

The gasoline preferably has a low or ultra low sulphur content, for instance at most 1000 mg/kg (otherwise known as ppm or ppmw or parts per million by weight), preferably no more than 500 mg/kg, more preferably no more than 100, even more preferably no more than 50 and most preferably no more than even 10 mg/kg.

The gasoline also preferably has a low total lead content, such as at most 0.005 g/l, most preferably being lead free—having no lead compounds added thereto (i.e., unleaded).

Examples of suitable gasolines include gasolines which have an olefinic hydrocarbon content of from 0 to 20% v/v (ASTM D1319), an oxygen content of from 0 to 5% m/m (EN 1601), an aromatic hydrocarbon content of from 0 to 50% v/v (ASTM D1319) and a benzene content of at most 1% v/v.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives. The concentration and nature of the optional fuel additive(s) that may be included in the base gasoline or the gasoline composition of the present invention is not critical. Non-limiting examples of suitable types of fuel additives that can be included in the base gasoline or the gasoline composition of the present invention include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1% m/m, more preferably in the range from 5 to 2000 mg/kg, advantageously in the range of from 300 to 1500 mg/kg, such as from 300 to 1000 mg/kg.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g., t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 mg/kg (e.g., from about 0.1 to about 10 mg/kg), more preferably from 1 to 15 mg/kg, still more preferably from 1 to 10 mg/kg, advantageously from 1 to 5 mg/kg based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g., p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO03/076554. Optionally anti-valve seat recession additives may be used such as sodium or potassium salts of polymeric organic acids.

The gasoline compositions herein may contain one or more organic sunscreen or UV filter compounds. There is no particular limitation on the type of organic sunscreen or UV filter compound which can be used in the gasoline compositions of the present invention as long as it is suitable for use in a gasoline composition.

A wide variety of conventional organic sunscreen actives are suitable for use herein. Sagarin, et al., at Chapter VIII, pages 189 et seq., of Cosmetics Science and Technology (1972), discloses numerous suitable actives.

Particularly preferred hydrophobic organic sunscreen actives useful in the composition of the present invention include: (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; and (viii) phenalkyl benzoate derivatives; and mixtures thereof.

The amount of the one or more organic sunscreen/UV filter compounds in the gasoline composition is preferably at most 2% m/m, by weight of the liquid fuel composition. The total level of the one or more organic sunscreen/UV filter compounds is preferably at least 10 mg/kg, by weight of the liquid fuel composition. The total level of the one or more organic sunscreen/UV filter compounds is more preferably in the range of from 1 to 0.005% m/m, more preferably in the range of from 0.5 to 0.01% m/m, even more preferably in the range of from 0.05% to 0.01% m/m, by weight of the liquid fuel composition.

The following types of organic UV sunscreen compounds are also suitable for use herein, in combination with the oxanilide compound(s): imidazoles, triazines, triazones and triazoles, and mixtures thereof.

Also suitable for use herein is one or more organic UV filter compounds selected from oxanilide compounds.

The gasoline compositions herein can also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$- to -$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e., having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylene-triamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

In the above, amounts (concentrations, % v/v, mg/kg (ppm), % m/m) of components are of active matter, i.e., exclusive of volatile solvents/diluent materials.

The liquid fuel composition of the present invention can be produced by admixing the naphtha and the oxygenated hydrocarbon with a gasoline base fuel suitable for use in an internal combustion engine. Since the base fuel to which the naphtha and the oxygenated hydrocarbon are admixed is a gasoline, then the liquid fuel composition produced is a gasoline composition.

The invention is further described by reference to the following non-limiting examples.

Example 1

A paper blending study was carried out to assess how much GTL naphtha can be blended in gasoline with ethanol content of up to 20% v/v. In the blending study ethanol at levels between 0 and 20% v/v was combined with refinery components set out in Table 1 below.

TABLE 1

| Property | Units | EtOH 5 % v/v | EtOH 10 % v/v | EtOH 20 % v/v | Isomerate | Alkylate | Raffinate | LCC | Heavy ref. | Butane | Toluene | GTL Naphtha |
|---|---|---|---|---|---|---|---|---|---|---|---|---|
| RON | — | 108 | 108 | 108 | 86.6 | 91.8 | 68.9 | 93.9 | 104.5 | 96.0 | 116.6 | 27.0 |
| MON | — | 90 | 90 | 90 | 83.5 | 89.1 | 66.7 | 82.5 | 94.4 | 92.0 | 101.6 | 32.0 |
| W | — | 1.0 | 1.0 | 1.0 | 0.0 | 0.0 | 0.0 | 1.0 | 2.0 | 0.0 | 1.5 | 0.0 |
| H | — | 4.5 | 4.5 | 4.5 | 1.7 | 1.4 | 1.2 | 2.0 | 0.8 | 1.5 | 0.0 | 1.4 |
| T | — | 6.8 | 6.8 | 6.8 | 1.7 | 1.1 | 1.1 | 3.0 | 1.7 | 2.4 | 1.7 | 1.0 |
| Density | $kg/m^3$ | 794 | 794 | 794 | 660 | 703 | 678 | 701 | 850 | 583 | 871 | 690 |
| RVP | kPa | 170 | 120 | 88 | 95.8 | 37.5 | 47.2 | 69.7 | 5.8 | 370.0 | 6.6 | 59.0 |
| Oxygen | % m/m | 35 | 35 | 35 | 0 | 0 | 0 | 0 | 0 | 0 | 0 | 0 |
| Aromatics | % v/v | 0 | 0 | 0 | 1 | 9 | 3 | 15 | 85 | 0 | 100 | 0 |
| Benzene | % v/v | 0 | 0 | 0 | 0.80 | 0.13 | 0.41 | 0.73 | 1.05 | 0 | 0 | 0 |
| Olefins | % v/v | 0 | 0 | 0 | 0 | 1 | 4 | 31 | 1 | 6 | 0 | 0 |
| Sulphur | mg/kg | 0 | 0 | 0 | 3 | 5.5 | 5.5 | 51.5 | 3 | 11 | 0.2 | 3 |
| E70 | % v/v | 270 | 235 | 139 | 85 | 13 | 51 | 62 | −12 | 100 | −5 | 9 |
| E100 | % v/v | 209 | 110 | 146 | 104 | 51 | 93 | 86 | 0 | 100 | 20 | 39 |
| E120 | % v/v | 198 | 100 | 118 | 105 | 80 | 98 | 95 | 20 | 103 | 90 | 62 |
| E150 | % v/v | 150 | 100 | 108 | 100 | 97 | 98 | 96 | 74 | 100 | 100 | 91 |
| E180 | % v/v | 105 | 100 | 101 | 100 | 100 | 100 | 100 | 100 | 96 | 100 | 98 |

Blending was then carried out in an Excel spreadsheet with a solver set to maximise the ratio of GTL naphtha, whilst maintaining the properties and composition of the final fuel within the requirements of the EN228 specification. The properties of oxygen content, aromatics, benzene, olefins and density were blended on a linear-by-volume basis. RVP was assumed to blend according to the Chevron rule:

$$RVP = \sum_{1}^{n} v_{fn} RVP_n^{1.5}$$

wherein RVP (kPa) is the Reid vapour pressure of the fuel, $v_{fn}$ is the volume fraction of component n and $RVP_n$ (kPa) is the Reid vapour pressure of component n. Different values of RVP are assigned for ethanol at 5, 10 and 20% v/v to account for its non-linear behaviour brought about by the different degrees of disruption of its hydrogen bonds when blended with hydrocarbons. Hartenhof calculations were used to assign values for E70, E100, E120, E150 and E180, which were then blended on a linear-by-volume basis. Again ethanol has different values assigned depending on whether it is present in the final blend at 5, 10 or 20% v/v. RON and MON of fuels were determined according to the BTI octane model which employs three component-specific coefficients (w, h and t).

Limiting fuel properties were set according to Table 2 with the only exception being that the oxygen content was allowed to increase beyond 2.7% m/m for E10 and E20 fuels. Blending performed across all of the five volatility classes (A-E) in Table 3 with the RVP always being set to the high end of the allowable range.

TABLE 2

Blending Model Requirements for Unleaded Gasoline

| Property | | Requirement |
|---|---|---|
| ULG95 | RON (—) | 95.0 min |
| | MON (—) | 85.0 min |
| ULG98 | RON (—) | 98.0 min |
| | MON (—) | 88.0 min |
| Oxygen (% m/m) | | 2.7 max |

TABLE 2-continued

Blending Model Requirements for Unleaded Gasoline

| Property | Requirement |
|---|---|
| Olefins (% v/v) | 10.0 max |
| Aromatics (% v/v) | 35.0 max |
| Benzene (% v/v) | 1.0 max |
| Density (kg/m$^3$) | 720-775 |

TABLE 3

Volatility Requirements for Unleaded Gasoline

| | Volatility class | | | | |
|---|---|---|---|---|---|
| Property | A | B | C | D | E |
| RVP (kPa) | 45-60 | 55-70 | 65-80 | 75-90 | 85-105 |
| E70 (% v/v) | 20-45 | 20-45 | 25-47 | 25-50 | 25-50 |
| E100 (% v/v) | 50-65 | 50-65 | 50-65 | 55-70 | 55-70 |

The blends generated by this exercise are presented below in Tables 4-8.

TABLE 4

Maximum Blend Ratio of GTL Naphtha in ULG98 and ULG95 E0 Gasoline (0% v/v ethanol)

| Properties and | ULG98 | | | | | ULG95 | | | | |
|---|---|---|---|---|---|---|---|---|---|---|
| Composition | A | B | C | D | E | A | B | C | D | E |
| Density (kg/m$^3$) | 743 | 740 | 739 | 728 | 732 | 744 | 742 | 740 | 736 | 732 |
| RON(—) | 98 | 98 | 98 | 98 | 98 | 95 | 95 | 95 | 95 | 95 |
| MON(—) | 88 | 88 | 88 | 88 | 88 | 86 | 86 | 86 | 86 | 86 |
| Aromatics (% v/v) | 35 | 34 | 35 | 31 | 35 | 35 | 35 | 35 | 35 | 35 |
| Olefins (% v/v) | 9 | 9 | 9 | 10 | 10 | 10 | 10 | 10 | 10 | 10 |
| RVP (kPa) | 60 | 70 | 80 | 90 | 105 | 60 | 70 | 80 | 90 | 105 |
| E70 (% v/v) | 25 | 25 | 26 | 31 | 34 | 28 | 29 | 30 | 37 | 38 |
| E100 (% v/v) | 50 | 50 | 50 | 55 | 55 | 50 | 50 | 50 | 55 | 55 |
| E150 (% v/v) | 92 | 93 | 92 | 94 | 92 | 89 | 89 | 89 | 89 | 89 |
| Benzene (% v/v) | 0.5 | 0.4 | 0.4 | 0.4 | 0.5 | 0.7 | 0.7 | 0.6 | 0.7 | 0.7 |
| Oxygen (% m/m) | 0.0 | 0.0 | 0.0 | 0.0 | 0.0 | 0.0 | 0.0 | 0.0 | 0.0 | 0.0 |
| Butane (% v/v) | 4 | 7 | 9 | 12 | 15 | 3 | 6 | 8 | 10 | 14 |
| Raffinate (% v/v) | 0 | 0 | 0 | 0 | 0 | 0 | 0 | 0 | 0 | 0 |
| Isomerate (% v/v) | 5 | 0 | 0 | 0 | 3 | 9 | 8 | 6 | 15 | 12 |
| LCC (% v/v) | 25 | 26 | 25 | 27 | 27 | 30 | 29 | 29 | 29 | 28 |
| Alkylate (% v/v) | 35 | 37 | 33 | 36 | 22 | 20 | 19 | 18 | 7 | 6 |
| Heavy ref. (% v/v) | 21 | 20 | 21 | 16 | 22 | 34 | 34 | 34 | 35 | 36 |
| Toluene (% v/v) | 10 | 10 | 10 | 10 | 10 | 0 | 0 | 0 | 0 | 0 |
| GTL naphtha (% v/v) | 0.2 | 0.7 | 1.2 | 0.0 | 0.4 | 4 | 5 | 5 | 4 | 5 |

TABLE 5

Maximum Blend Ratio of GTL Naphtha in ULG98 and ULG95 E5 Gasoline (5% v/v Ethanol)

| Properties and | ULG98 | | | | | ULG95 | | | | |
|---|---|---|---|---|---|---|---|---|---|---|
| Composition | A | B | C | D | E | A | B | C | D | E |
| Density ($kg/m^3$) | 752 | 750 | 748 | 745 | 741 | 753 | 751 | 748 | 745 | 742 |
| RON(—) | 98 | 98 | 98 | 98 | 98 | 95 | 95 | 95 | 95 | 95 |
| MON(—) | 88 | 89 | 89 | 88 | 88 | 86 | 86 | 86 | 86 | 86 |
| Aromatics (% v/v) | 35 | 35 | 35 | 35 | 35 | 35 | 35 | 35 | 35 | 35 |
| Olefins (% v/v) | 7 | 7 | 6 | 9 | 8 | 8 | 8 | 7 | 10 | 9 |
| RVP (kPa) | 60 | 70 | 80 | 90 | 105 | 60 | 70 | 80 | 90 | 105 |
| E70 (% v/v) | 30 | 31 | 32 | 39 | 40 | 31 | 32 | 33 | 40 | 41 |
| E100 (% v/v) | 50 | 50 | 50 | 55 | 55 | 50 | 50 | 50 | 55 | 55 |
| E150 (% v/v) | 92 | 92 | 92 | 92 | 92 | 91 | 91 | 91 | 91 | 91 |
| Benzene (% v/v) | 0.6 | 0.6 | 0.6 | 0.6 | 0.6 | 0.6 | 0.6 | 0.6 | 0.6 | 0.6 |
| Oxygen (% m/m) | 1.8 | 1.8 | 1.8 | 1.9 | 1.9 | 1.8 | 1.8 | 1.8 | 1.9 | 1.9 |
| Butane (% v/v) | 3 | 6 | 9 | 10 | 14 | 3 | 5 | 8 | 10 | 14 |
| Raffinate (% v/v) | 0 | 0 | 0 | 0 | 0 | 0 | 0 | 0 | 0 | 0 |
| Isomerate (% v/v) | 0 | 0 | 0 | 0 | 0 | 0 | 0 | 0 | 1 | 0 |
| LCC (% v/v) | 21 | 18 | 15 | 25 | 22 | 24 | 22 | 19 | 29 | 25 |
| Alkylate (% v/v) | 34 | 34 | 33 | 22 | 20 | 24 | 23 | 23 | 11 | 10 |
| Heavy ref. (% v/v) | 21 | 20 | 21 | 16 | 22 | 34 | 34 | 34 | 35 | 36 |
| GTL naphtha (% v/v) | 3 | 3 | 3 | 3 | 3 | 10 | 10 | 10 | 10 | 10 |

TABLE 6

Maximum Blend Ratio of GTL Naphtha in ULG98 and ULG95 E10 Gasoline (10% v/v Ethanol)

| Properties and | ULG98 | | | | | ULG95 | | | | |
|---|---|---|---|---|---|---|---|---|---|---|
| Composition | A | B | C | D | E | A | B | C | D | E |
| Density ($kg/m^3$) | 758 | 755 | 753 | 749 | 739 | 758 | 756 | 754 | 744 | 737 |
| RON(—) | 99 | 98 | 99 | 98 | 98 | 95 | 95 | 95 | 95 | 95 |
| MON(—) | 88 | 88 | 88 | 88 | 88 | 85 | 85 | 85 | 85 | 86 |
| Aromatics (% v/v) | 35 | 35 | 35 | 35 | 31 | 35 | 35 | 35 | 31 | 29 |
| Olefins (% v/v) | 9 | 5 | 8 | 6 | 7 | 9 | 10 | 9 | 10 | 8 |
| RVP (kPa) | 60 | 70 | 80 | 90 | 105 | 60 | 70 | 80 | 90 | 105 |
| E70 (% v/v) | 42 | 45 | 44 | 50 | 50 | 44 | 44 | 45 | 50 | 50 |
| E100 (% v/v) | 50 | 51 | 50 | 55 | 55 | 50 | 50 | 50 | 55 | 55 |
| E150 (% v/v) | 89 | 89 | 89 | 89 | 90 | 88 | 88 | 88 | 90 | 90 |
| Benzene (% v/v) | 0.6 | 0.6 | 0.6 | 0.6 | 0.5 | 0.6 | 0.6 | 0.6 | 0.6 | 0.5 |
| Oxygen (% m/m) | 3.6 | 3.7 | 3.7 | 3.7 | 3.7 | 3.6 | 3.6 | 3.7 | 3.7 | 3.7 |
| Butane (% v/v) | 3 | 4 | 8 | 10 | 14 | 2 | 4 | 7 | 9 | 13 |
| Raffinate (% v/v) | 0 | 0 | 0 | 8 | 0 | 0 | 0 | 0 | 0 | 0 |
| Isomerate (% v/v) | 0 | 13 | 1 | 7 | 2 | 4 | 1 | 0 | 2 | 0 |
| LCC (% v/v) | 27 | 13 | 22 | 15 | 19 | 29 | 29 | 28 | 29 | 23 |
| Alkylate (% v/v) | 23 | 18 | 20 | 9 | 19 | 8 | 7 | 6 | 7 | 12 |
| Heavy ref. (% v/v) | 34 | 37 | 35 | 37 | 31 | 35 | 36 | 36 | 31 | 29 |
| GTL naphtha (% v/v) | 3 | 5 | 5 | 3 | 5 | 13 | 13 | 14 | 12 | 13 |

TABLE 7

Maximum Blend Ratio of GTL Naphtha in ULG98 and ULG95 E20 Gasoline (20% v/v Ethanol)

| Properties and | ULG98 | | | | | ULG95 | | | | |
|---|---|---|---|---|---|---|---|---|---|---|
| Composition | A | B | C | D | E | A | B | C | D | E |
| Density ($kg/m^3$) | 763 | 760 | 758 | 755 | 751 | 772 | 770 | 767 | 764 | 760 |
| RON(—) | 98 | 98 | 98 | 98 | 98 | 95 | 95 | 95 | 95 | 95 |
| MON(—) | 88 | 88 | 88 | 88 | 88 | 85 | 85 | 85 | 85 | 85 |
| Aromatics (% v/v) | 30 | 30 | 30 | 30 | 30 | 35 | 35 | 35 | 35 | 34 |
| Olefins (% v/v) | 1 | 1 | 1 | 1 | 2 | 2 | 1 | 1 | 3 | 2 |
| RVP (kPa) | 60 | 70 | 80 | 90 | 105 | 60 | 70 | 80 | 90 | 105 |
| E70 (% v/v) | 33 | 35 | 37 | 39 | 42 | 32 | 32 | 34 | 40 | 41 |
| E100 (% v/v) | 54 | 55 | 56 | 57 | 59 | 50 | 50 | 51 | 55 | 55 |
| E150 (% v/v) | 91 | 91 | 91 | 91 | 91 | 89 | 89 | 89 | 89 | 89 |
| Benzene (% v/v) | 0.4 | 0.4 | 0.4 | 0.4 | 0.4 | 0.5 | 0.4 | 0.4 | 0.5 | 0.4 |
| Oxygen (% m/m) | 7.2 | 7.3 | 7.3 | 7.3 | 7.3 | 7.1 | 7.2 | 7.2 | 7.2 | 7.3 |
| Butane (% v/v) | 4 | 6 | 8 | 11 | 15 | 3 | 6 | 8 | 10 | 15 |
| Raffinate (% v/v) | 0 | 0 | 0 | 0 | 0 | 0 | 0 | 0 | 0 | 0 |
| Isomerate (% v/v) | 0 | 0 | 0 | 0 | 0 | 0 | 0 | 0 | 0 | 0 |
| LCC (% v/v) | 0 | 0 | 0 | 0 | 0 | 3 | 0 | 0 | 7 | 3 |
| Alkylate (% v/v) | 30 | 28 | 25 | 23 | 18 | 12 | 11 | 9 | 1 | 0 |
| Heavy ref. (% v/v) | 33 | 33 | 33 | 33 | 33 | 39 | 40 | 40 | 39 | 40 |
| GTL naphtha (% v/v) | 13 | 13 | 13 | 13 | 13 | 22 | 22 | 22 | 22 | 22 |

TABLE 8

Maximum Blend Ratio of GTL Naphtha that can be Blended into Gasoline with Different Ethanol Content and Octane Requirements

| EtOH content | Possible GTL naphtha content (% v/v) | |
|---|---|---|
| (% v/v) | ULG98 | ULG95 |
| 0 | 0-1 | 4-5 |
| 5 | 3 | 10 |
| 10 | 3-5 | 12-14 |
| 20 | 13 | 22 |

The results of the blending study (see especially Table 8) show two basic trends. The maximum blend ratio of GTL naphtha in EN228 compliant fuel increases (i) as the octane requirement of the grade is reduced and (ii) as the ethanol content of the gasoline is increased.

Gasoline without ethanol can only sustain low levels (<5% v/v) of naphtha. However, significant blend ratios can be achieved in E5, E10 and E20. In particular, the study concluded that 3-10% v/v of GTL naphtha can be blended in E5 gasoline (i.e. gasoline containing 5% v/v ethanol), 3-15% v/v of GTL naphtha can be blended in E10 gasoline (i.e. gasoline containing 10 vol. % ethanol) and 13-22% v/v of GTL naphtha can be blended in E20 gasoline (i.e. gasoline containing 20% v/v ethanol).

Importantly, the volumes of GTL naphtha which are achieved in this study are large enough to allow GTL naphtha to be diverted from its usual application as a steam cracker feedstock to that of a gasoline component.

Example 2

Several fuel blends were prepared having the properties and compositions as shown in Table 9 below. All the fuel blends were blended to meet the EN228 Class A specification.

Fuel A was an ULG 95 RON E5 (containing 5% v/v ethanol) meeting the EN228 Class A specification. Fuel A was used as a benchmark to compare the power and emissions performance of the other fuel blends.

Fuel B was a ULG 95 RON E0 fuel containing 0% v/v ethanol and 7.3% v/v of GTL naphtha.

Fuel C was a ULG 95 RON E5 fuel containing 5% v/v ethanol and 11.4% v/v of GTL naphtha.

Fuel D was a ULG 95 RON E10 fuel containing 10% v/v ethanol and 15.4% v/v of GTL naphtha.

Fuel E was a ULG 95 RON E20 fuel containing 20% v/v ethanol and 23.5% v/v of GTL naphtha.

The EN228 Class A specifications detailed in Table 9 are for ULG with a maximum oxygen content of 3.7% m/m, whereas in the paper blend study it is for a maximum oxygen content of 2.7% m/m.

The fuel analysis results in Table 9 below show that GTL naphtha can be used as a gasoline blending component to give an EN228 compliant fuel with increasing blend ratios achieved with increasing content of ethanol.

TABLE 9

| Properties and Composition | Test Method | EN228 Class A | Fuel A*[1] | Fuel B* | Fuel C | Fuel D | Fuel E[2] |
|---|---|---|---|---|---|---|---|
| Ethanol (% v/v) | | | 5.0 | 0 | 5.0 | 10.0 | 20.0 |
| Isomerate (% v/v) | | | | 15.9 | 13.7 | 1.8 | 5.8 |
| Alkylate (% v/v) | | | | 18.6 | 16.1 | 31.0 | 12.0 |
| LCC (% v/v) | | | | 21.2 | 17.1 | 16.4 | 0 |
| Heavy Reformate (% v/v) | | | | 24.8 | 25.6 | 14.4 | 25.3 |
| Butane (% v/v) | | | | 2.2 | 1.1 | 1.0 | 3.4 |
| Toluene (% v/v) | | | | 10.0 | 10.0 | 10.0 | 10.0 |
| GTL naphtha (% v/v) | | | | 7.3 | 11.4 | 15.4 | 23.5 |
| Total (% v/v) | | | | 100 | 100 | 100 | 100 |
| Density at 15° C. ($kg/m^3$) | DIN EN ISO 12185 | 720.0-775.0 | 742.9 | 748.7 | 754.7 | 743.4 | 767.3 |
| RON corrected | DIN EN ISO 5164 | 95.0 min | 95.3 | 96.0 | 95.8 | 96.1 | 96.2 |
| MON corrected | DIN EN ISO 5163 | 85.0 min | 85.2 | 85.6 | 85.4 | 86.1 | 86.1 |
| DVPE (kPa) | DIN ISO 13016-1 | 45.0-60.0 | 57.8 | 54.6 | 56.3 | 55.3 | 50.2 |
| E70 (% v/v) | DIN EN ISO 3405 | 22.0-50.0 | 37.9 | 23.6 | 31.0 | 37.7 | 23.7 |
| E100 (% v/v) | DIN EN ISO 3405 | 46.0-72.0 | 56.2 | 50.6 | 49.5 | 50.2 | 56.0 |
| E150 (% v/v) | DIN EN ISO 3405 | 75.0 min | 86.4 | 90.6 | 91.1 | 93.1 | 91.0 |
| Olefins (% v/v) | DIN EN ISO 22854 | 18.0 max | 10.1 | 11.5 | 8.8 | 9.0 | 0.3 |
| Aromatics (% v/v) | DIN EN ISO 22854 | 35.0 max | 26.0 | 35.2 | 34.9 | 25.6 | 33.0 |
| Benzene (% v/v) | ASTM D 6729 modified | 1.00 max | 0.78 | 0.65 | 0.60 | 0.35 | 0.31 |
| Oxygen content (% m/m) | ASTM D 5291 modified | 3.7 max | 2.34 | 0.0 | 1.56 | 3.10 | 7.20 |
| Lower heating Value (MJ/kg) | DIN 51900-1 | — | 40.94 | 41.97 | 41.18 | 40.57 | 38.17 |

[1]Original fuel blending details were not available for Fuel A.
[2]Fuel E is an E20 blend and exceeds the current EN228 specification for the mass fraction of 3.7% m/m, as the specification is designed for E10 fuels.
*Comparative examples Emissions and Power Performance Tests Fuels A-E were tested in a gasoline single cylinder engine manufactured by AVL to understand if the GTL naphtha containing blends would give comparable fuel consumption, pre-catalyst emissions and power performance to a standard EN228 ULG 95 RON E5 fuel (Fuel A). The engine specification details are set out in Table 10 below.

TABLE 10

| Engine Specification Details | |
|---|---|
| Manufacturer | AVL |
| Type | Gasoline Single Cylinder Engine |
| Emissions Class | Euro 6 Engine Hardware |
| Combustion system | 4-valve pent roof GDI, Otto cycle |

TABLE 10-continued

| Engine Specification Details | |
|---|---|
| Displacement (bore/stroke) | 454 $cm^3$ (82 mm/86 mm) |
| Compression Ratio | 7-14 |
| Injection System | Piezo injector Direct injection pressure up to 200 bar Port fuel injection pressure up to 4.5 bar |
| Ignition System | Ignition coil |
| Engine Management System | IAV GmbH - F12RE |
| Maximum Boost Pressure | 3.0 bar |
| Maximum Engine Speed | 6400 rpm |

All the fuels were tested in two engine configurations representing present and future engine hardware. A wide range of engine conditions (varying speed and load steady state test points) were tested for each configuration.

The pre-catalyst emissions were measured with a Horiba Mexa 7100 system and fuel consumption was determined using an AVL 735 Coriolis meter. In-cylinder pressure measurements were taken using an AVL piezo-electric GU22C sensor. The power output is related to the indicated mean effective pressure (IMEP), which is derived from the in-cylinder pressure measurements. Tables 11 and 12 set out the operating conditions for the gasoline direct injection (GDI) configuration and the port fuel injection (PFI) configuration, respectively.

TABLE 11

Operating Conditions and Results for the Gasoline Direct Injection (GDI) Configuration

| Engine Speed (rpm) | 1000 | 1800 | 2500 | 3500 | 4500 |
|---|---|---|---|---|---|
| Maximum Boost Pressure (bar) | 1.6 | 2.0 | 2.0 | 2.0 | 2.0 |
| Compression Ratio | | | 9.5:1 | | |
| Intake valve open/close timing at 1 mm valve lift (° ATDC) | 7.8/199.1 | 17.8/209.1 | 22.8/214.1 | 12.8/204.1 | 2.8/194.2 |
| Exhaust valve open/close timing at 1 mm valve lift (° ATDC) | −229.4/−18.0 | −214.4/−3.0 | −214.4/−3.0 | −214.4/−3.0 | −214.4/−3.0 |
| Injection Timing (° ATDC) | | | 325/−285/−245/−205/−165 | | |
| Injection Pressure (bar) | | | 200 | | |
| Ignition (° ATDC) | 2 | 2 | −3 | −4 | −7 |
| Lambda (° C.) | | | 1.0 | | |
| Oil Temperature (° C.) | | | 87 | | |
| Fuel Temperature (° C.) | | | 25 | | |
| Coolant Temperature (° C.) | | | 80 | | |
| Intake Air Temperature (° C.) | | | 38 | | |

TABLE 12

Operating conditions for the port fuel injection (PFI) configuration

| Engine Speed (rpm) | 1000 | 1800 | 2500 | 3500 |
|---|---|---|---|---|
| Maximum Boost Pressure (bar) | 1.6 | 2.0 | 2.0 | 2.0 |
| Compression Ratio | | 9.5:1 | | |
| Intake valve open/close timing at 1 mm valve lift (° ATDC) | −7.2/184.2 | 17.8/209.1 | 17.8/209.1 | 22.8/214.1 |
| Exhaust valve open/close timing at 1 mm valve lift (° ATDC) | −209.4/2.0 | −219.4/8.0 | −219.4/8.0 | −219.4/8.0 |
| Injection Timing (° ATDC) | −492 | −620 | −679 | −865 |
| Injection Pressure (bar) | | 4.5 | | |
| Ignition (° ATDC) | 9 | 4 | −1.5 | −2.5 |
| Lambda (° C.) | | 1.0 | | |
| Oil Temperature (° C.) | | 87 | | |
| Fuel Temperature (° C.) | | 25 | | |
| Coolant Temperature (° C.) | | 80 | | |
| Intake Air Temperature (° C.) | | 38 | | |

Results

Tables 13 and 14 set out the IMEP results obtained for the two engine configurations over a range of speeds at full load engine operating conditions.

TABLE 13

IMEP Results for the Gasoline Direct Injection (GDI) Configuration

| Engine Speed (rpm) | Fuel A | Fuel B | Fuel C | Fuel D | Fuel E |
|---|---|---|---|---|---|
| | | | IMEP (bar) | | |
| 1000 | 14.37 | 14.35 | 14.19 | 14.23 | 14.09 |
| 1800 | 19.27 | 19.43 | 19.36 | 19.35 | 19.29 |
| 2500 | 19.52 | 19.57 | 19.57 | 19.60 | 19.53 |
| 3500 | 21.43 | 21.41 | 21.45 | 21.39 | 21.59 |
| 4500 | 22.11 | 22.00 | 21.93 | 21.97 | 22.35 |

TABLE 14

IMEP results for the port fuel injection (PFI) configuration

| Engine Speed (rpm) | Fuel A | Fuel B | Fuel C | Fuel D | Fuel E |
|---|---|---|---|---|---|
| | | | IMEP (bar) | | |
| 1000 | 13.74 | 13.09 | 13.16 | 13.23 | 12.95 |
| 1800 | 18.32 | 18.24 | 18.23 | 18.23 | 18.16 |
| 2500 | 18.96 | 18.91 | 18.80 | 18.86 | 18.75 |
| 3500 | 20.45 | 20.29 | 20.33 | 20.30 | 20.45 |

Figure 2:
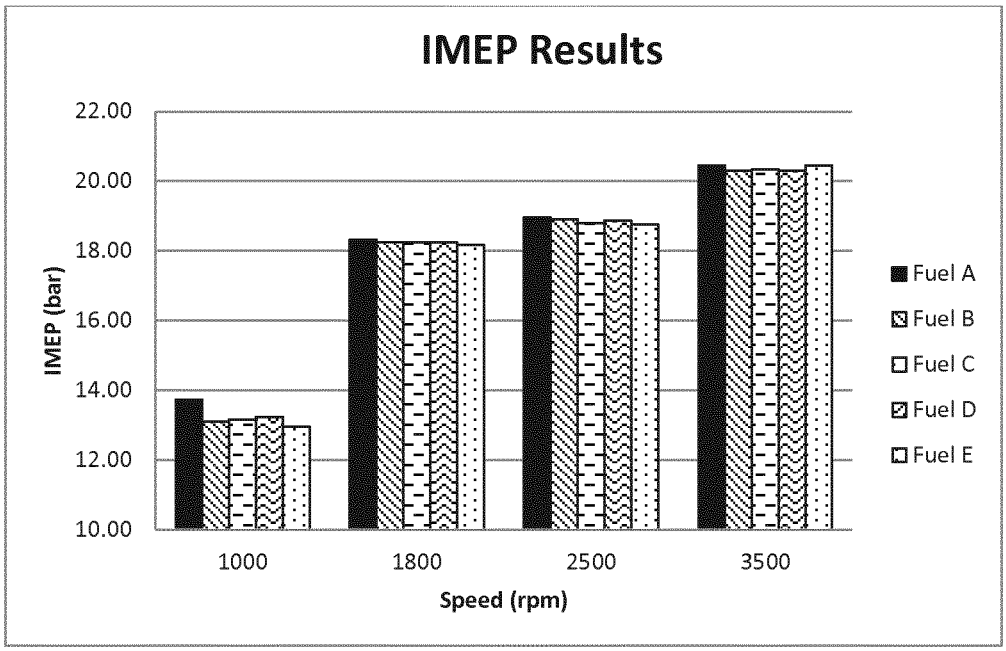
FIG. 2 is a graphical representation of the results shown in Table 14.

The results set out in Table 13 and 14 are shown graphically in FIGS. 1 and 2, respectively.

Tables 15 and 16 below set out the fuel consumption and pre-catalyst emissions results obtained for the two engine configurations at 1000 rpm.

TABLE 15

Fuels Consumption and Emissions Results for the Gasoline Direct Injection (GDI) Configuration

| | Fuel A | Fuel B | Fuel C | Fuel D | Fuel E |
|---|---|---|---|---|---|
| Fuel Consumption (g/kWh) | 280.22 | 272.59 | 282.88 | 283.11 | 305.43 |
| CO emissions (g/kWh) | 21.78 | 23.05 | 22.19 | 21.68 | 21.87 |
| NOx emissions (g/kWh) | 22.57 | 20.16 | 21.05 | 20.90 | 23.28 |
| THC emissions (g/kWh) | 8.63 | 7.85 | 8.83 | 7.71 | 10.62 |
| PN emissions (*/kWh) | 2.92E+13 | 1.63E+13 | 1.40E+13 | 1.05E+13 | 1.74E+13 |
| PM emissions (mg/kWh) | 7.67 | 2.69 | 2.57 | 1.56 | 2.98 |

TABLE 16

Fuel Consumption and Emissions Results for the port fuel injection (PFI) configuration

| Parameter | Fuel A | Fuel B | Fuel C | Fuel D | Fuel E |
|---|---|---|---|---|---|
| Fuel Consumption (g/kWh) | 294.64 | 291.12 | 299.62 | 298.10 | 320.51 |
| CO emissions (g/kWh) | 17.54 | 25.58 | 27.96 | 29.07 | 28.64 |
| NOx emissions (g/kWh) | 21.18 | 18.01 | 20.74 | 19.74 | 22.07 |
| THC emissions (g/kWh) | 12.15 | 8.90 | 10.31 | 8.15 | 11.64 |
| PN emissions (*/kWh) | 5.67E+13 | 2.12E+13 | 3.06E+13 | 1.97E+13 | 3.35E+13 |
| PM emissions (mg/kWh) | 52.15 | 11.44 | 18.30 | 7.39 | 18.42 |

Discussion

The results for the IMEP for both engine configurations (GDI & PFI) at the different engine speeds show that the fuel compositions according to the present invention comprising GTL naphtha and ethanol (Fuels C-E) perform similarly to the conventional EN228 gasoline (Fuel A).

For both engine configurations, Fuels C & D have a similar fuel consumption performance to the conventional EN228 gasoline (Fuel A). For Fuel B (containing GTL naphtha but no ethanol) it is lower and for Fuel E it is higher compared to Fuel A due to the caloric values (lower heating values) being different and effecting the fuel consumption values.

For both engine configurations, the pre-catalyst emissions (CO, NOx, THC, PN and PM) performance for the fuel compositions according to the present invention (Fuels C-E) comprising GTL naphtha and ethanol are similar to the reference fuel (Fuel A).

That which is claimed is:

1. A liquid fuel composition for a spark ignition internal combustion engine, the liquid fuel composition comprising:

(a) a concentration of 3% to 25% by volume of the liquid fuel composition of a Fischer-Tropsch derived naphtha comprising a mixture of hydrocarbons having between 5 and 12 carbon atoms, a RON from 27 to 32, and a MON from 27 to 32;

(b) a concentration of 5% to 25% by volume of the liquid fuel composition of an oxygenated hydrocarbon; and (c) a gasoline base fuel, wherein the liquid fuel composition has a density from 720 kg/m$^3$ to 775 kg/m$^3$, a RON from 85 to 105, and a MON from 75 to 90.

2. The liquid fuel composition according to claim 1, wherein the oxygenated hydrocarbon is at the concentration of 5% to 20% by volume of the liquid fuel composition.

3. The liquid fuel composition according to claim 1, wherein the oxygenated hydrocarbon is at a concentration of 5% to 10% by volume of the liquid fuel composition, and wherein the Fischer-Tropsch derived naphtha is at a concentration of 3% to 15% by volume of the liquid fuel composition.

4. The liquid fuel composition according to claim 1, wherein the oxygenated hydrocarbon is at a concentration of 10% to 25% by volume of the liquid fuel composition, and wherein the Fischer-Tropsch derived naphtha is at a concentration of 10% to 25% by volume of the liquid fuel composition.

5. The liquid fuel composition according to claim 1 wherein the oxygenated hydrocarbon is selected from alcohols, ethers, esters, ketones, aldehydes, carboxylic acids and their derivatives, oxygen containing heterocyclic compounds, and mixtures thereof.

6. The liquid fuel composition according to claim 1 wherein the oxygenated hydrocarbon is selected from alcohols, ethers, esters, and mixtures thereof.

7. The liquid fuel composition according to claim 1 wherein the oxygenated hydrocarbon is selected from alcohols, ethers, and mixtures thereof.

8. The liquid fuel composition according to claim 1 wherein the oxygenated hydrocarbon is selected from an alcohol.

9. The liquid fuel composition according to claim 8 wherein the alcohol is selected from methanol, ethanol, propanol, 2-propanol, butanol, tert-butanol, iso-butanol and 2-butanol, and mixtures thereof.

10. The liquid fuel composition according to claim 9 wherein the alcohol is ethanol.

11. The liquid fuel composition according to claim 1, wherein the liquid fuel composition has a benzene content of at most 1% v/v.

12. The liquid fuel composition according to claim 1, wherein the liquid fuel composition has an aromatics content of at most 35% v/v.

13. The liquid fuel composition according to claim 1, wherein the liquid fuel composition has an olefins content of at most 10% v/v.

14. A liquid fuel composition for a spark ignition internal combustion engine, the liquid fuel composition comprising:

(a) a concentration of at least 10% by volume of the liquid fuel composition of a Fischer-Tropsch derived naphtha;

(b) a concentration of 5% to 25% by volume of the liquid fuel composition of an oxygenated hydrocarbon; and (c) a gasoline base fuel, wherein the liquid fuel composition has a density from 720 $kg/m^3$ to 775 $kg/m^3$, and a RON of 96 or less.

* * * * *